US006579113B2

(12) United States Patent
Kodama

(10) Patent No.: US 6,579,113 B2
(45) Date of Patent: Jun. 17, 2003

(54) INERTIAL LOCKING CONNECTOR

(75) Inventor: Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/840,186

(22) Filed: Apr. 24, 2001

(65) Prior Publication Data

US 2001/0049220 A1 Dec. 6, 2001

(30) Foreign Application Priority Data

Jun. 1, 2000 (JP) ..... 2000-164179

(51) Int. Cl.[7] ..... H01R 13/627
(52) U.S. Cl. ..... 439/358
(58) Field of Search ..... 439/358, 357, 439/353, 352

(56) References Cited

U.S. PATENT DOCUMENTS 4,915,643 A * 4/1990 Samejima et al. ..... 439/357
4,925,398 A * 5/1990 Samejima et al. ..... 439/357
4,946,404 A * 8/1990 Takenouchi et al. ..... 439/357
5,769,650 A * 6/1998 Aoyama et al. ..... 439/357
5,775,932 A * 7/1998 Saito et al. ..... 439/358
5,788,527 A * 8/1998 Sanders et al. ..... 439/357
5,820,400 A * 10/1998 Yamanashi et al. ..... 439/358
5,876,232 A 3/1999 Matsushita et al. ..... 439/357
6,007,361 A * 12/1999 Flachslaender ..... 439/358
6,089,898 A * 7/2000 Lincoln, III et al. ..... 439/357
6,217,365 B1 * 4/2001 Shinozaki ..... 439/358
6,325,656 B1 * 12/2001 Fukuda et al. ..... 439/358

FOREIGN PATENT DOCUMENTS

JP 9-293566 11/1997
JP 110523 * 4/2001

* cited by examiner

*Primary Examiner*—Javaid Nasri
(74) *Attorney, Agent, or Firm*—Armstrong, Westerman & Hattori, LLP

(57) ABSTRACT

An inertial locking connector is provided, by which the appropriation of a normal connector is improved and an incomplete engagement of the connectors is securely prevented from occurring. The inertial locking connector includes: a first connector housing provided with a locking arm having a locking projection; and a second connector housing provided with an engaging projection, which engages with the locking projection, wherein upon engaging of the first and second connecor housings, a front end face of the locking projection is situated facing a perpendicular front end face of the second connector housing and the front end face of the locking projection abuts against the front end face of the second connector housing. Thereby, the inertia force upon the engagement of the connectors is exhibited.

9 Claims, 4 Drawing Sheets

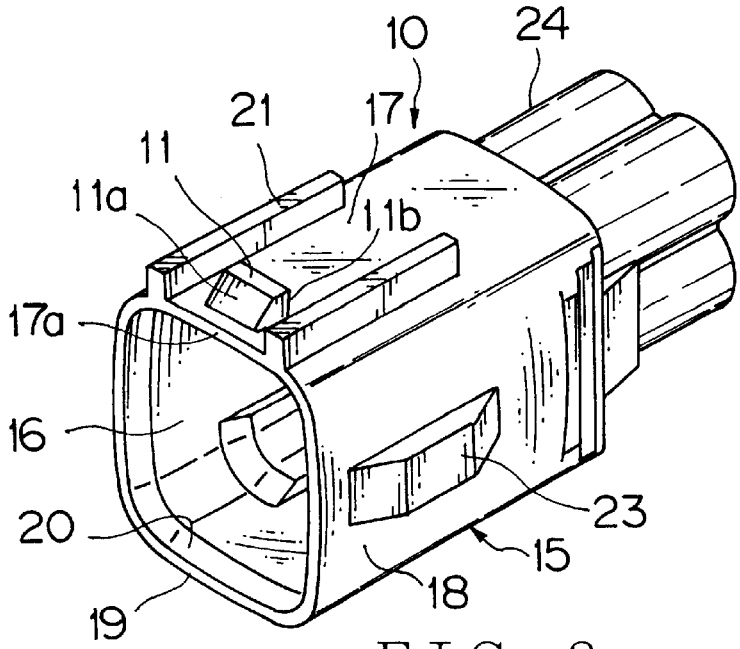
FIG. 3
FIG. 4A
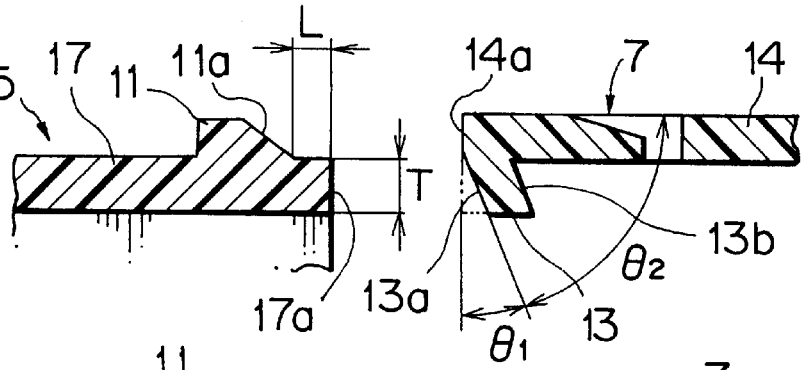
FIG. 4B
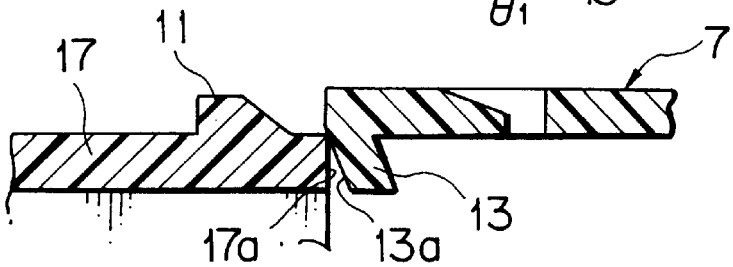
FIG. 4C
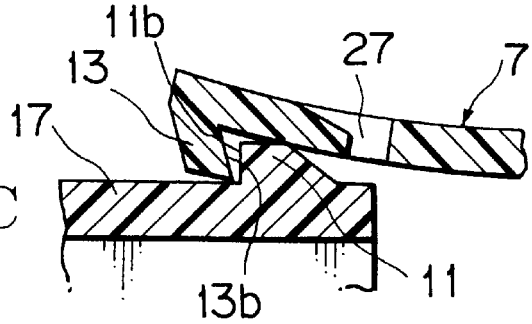

FIG.8
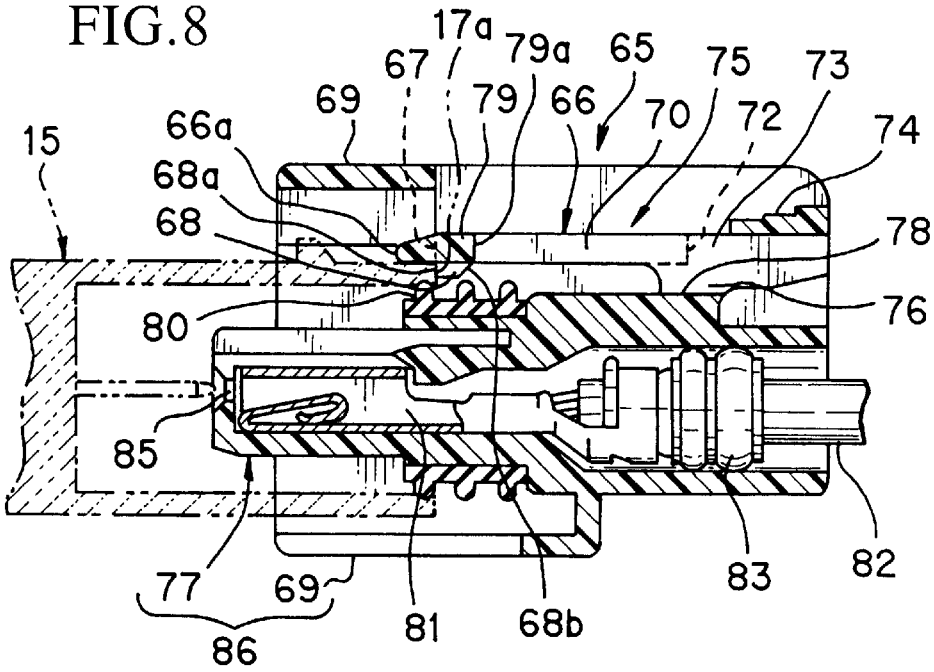
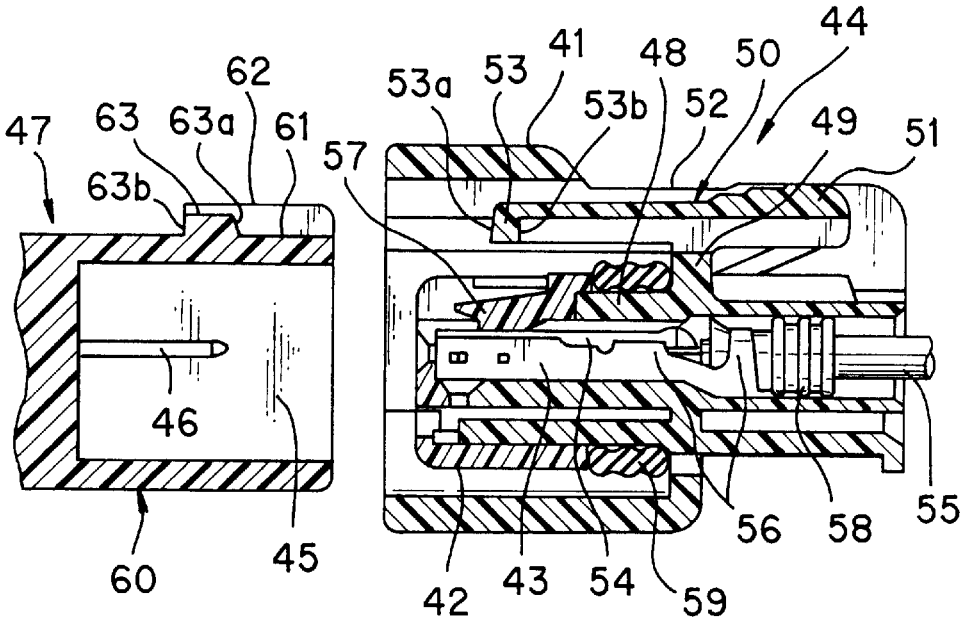
FIG.9
PRIOR ART

INERTIAL LOCKING CONNECTOR

BACKGROUND OF THE INVENTION (1) Field of the Invention

This invention relates to an inertial locking connector, which engages connectors with each other by using the inertia force and, more specifically, to an inertial locking connector, which can appropriate a known non-inertial locking connector for one of a pair of the connectors.

(2) Description of the Related Art

FIG. 9 illustrates an example of a conventional inertial locking connector.

The conventional inertial locking connector consists of a male connector 44, which receives female terminals 43 in its block-shaped housing 42 (a part for receiving terminals) inside a hood part 41, and a female connector 47, in which tabs of male terminals 46 are protruded in a connector engaging chamber 45 mating with the housing 42. In this specification, a connector having the block-shaped housing 42 is defined as a male connector, while a connector having the connector engaging chamber 45 is defined as a female connector.

A connector housing of the male connector 44 consists of the outside hood part 41 and the inner housing 42, which are integrally molded using synthetic resin. A flexible locking arm 50 is integrally formed with an upper wall 48 of the inner housing 42 through a holding part 49, which is situated at the middle of the length direction of the locking arm 50. The front half of the locking arm 50 is located inside of the hood part 41, while an operating part 51 of the rear half of the locking arm 50 is exposed outward from an opening 52 of the hood part 41.

A locking projection 53 is formed downwardly at a front end of the locking arm 50 and a front end face 53*a* of the locking projection 53 is an abutting face, which is formed approximately perpendicular or inclined facing front with regard to the female connector 47. There is provided a terminal receiving chamber 54 in the inner housing 42, in which a female terminal 43 having wires is received. The female terminal 43 has a box-shaped electric contact part (indicated by the abbreviation numeral 43) having a resilient contact piece (not shown in the figure) therein, which mates with the tab of male terminal 46, and a solderless contact part 56, to which a wire 55 is connected and fixed. A hole at the central part of the electric contact part (43) of the female terminal 43 is locked by a flexible locking lance 57.

A waterproof rubber stopper 58 is inserted on the wire 55, while the outer periphery of the waterproof rubber stopper 58 adheres closely to the rear inner surface of the terminal receiving chamber 54. A waterproof packing 59 for the female connector 47 is provided on the outer base of the inner housing 42.

In the female connector 47, a pair of guide walls 62 for the locking arm 50 are formed at both sides on an opper wall 61 of the connector housing 60, which forms the connector engaging chamber 45, while an engaging projection 63 engaging with the locking projection 53 is formed between a pair of the guide walls 62. The engaging projection 63 has a front end face (abutting face) 63*a*, which faces the front end face 53*a* of the locking projection 53 and is inclined a little backward, and a perpendicular rear end face (engaging face) 63*b*, which engages with a rear end face (locking face) 53*b* of the locking projection 53.

The tab at the front half of the male terminal 46 protrudes in the connector engaging chamber 45, while the rear half of the male terminal 46 is received into a terminal receiving chamber (not shown in the figure) of the connector housing 60 and continues to a wire (not shown in the figure). Otherwise, the connector housing 60 is integrally formed with an instrument and the like, and one side of the plate-shaped male terminal 46 that has a tab at an oppsite side thereof continues to a busbar and the like at the instrument side.

When an operator starts to fit the connecors 44 and 47 to each other starting from the state shown in FIG. 9, both ends of the male and female terminals, 46 and 43, respectively, come into light contact with each other and at the same time the front end face 53*a* of the locking projection 53 of the locking arm 50 strongly abuts against the front end face 63*a* of the engaging projection 63. Then, the operator pushes both connectors 44 and 47 in the engaging direction with a strong force, resulting in that the front end face 53*a* of the locking projection 53 slides upward along the front end face 63*a* of the engaging projection 63 so as to bend the locking arm 50, the abutting between both projections 53 and 63 is released, and both connectos 44 and 47 are engaged with each other by force with the aid of the inertia force thereof. When the locking projection 53 climbs over the engaging projection 63, the locking arm 50 restores to the original state with shifting downward and the rear end face 53*b* of the locking projection 53 abuts against the rear end face 63*b* of the engaging projection 63.

Thereby, both connectors 44 and 47 are locked together, preventing both connectors from coming off abruptly. This connector engagement using the inertia force thereof exhibits a secure engaging force even when an insertion force of the male or female terminal (46 or 43) is large (especially when the number of the terminals is large) and when the inner periphery of the connector housing 60 adheres closely to the outer periphery of the waterproof packing 59.

However, according to the structure of the conventional inertial locking connector, when the operator uses an insufficient force to fit the connecors 44 and 47 to each other, there is the possibility that both connectors stop staying in half engaged condition (i.e. incomplete engaged condition) in a state that the locking projection 53 of the locking arm 50 of the connector 44 climbs on the engaging projection 63 of the connector 47. In this case, since both terminals 46 and 43 are inserted by as long as about half of the regular stroke, both connectors 44 are tentatively held with each other without coming off, therefore there is the possibility that the operator judges that both connectors are completely engaged with each other and advances it to the next process.

Further, not to mention the locking arm 50, the engaging projection 63 needs a machining to enlarge the incline of the front end face 63*a* for the purpose of the inertial locking, forcing both connectors 44 and 47 to be exclusively manufactured as the inertial locking parts. Furthermore, a normal connector, which does not implement the inertial locking, can be neither appropriated nor compatible with the inertial locking part, causing an uneconomical situation. Furthermore, since the rear end face 53*b* of the locking projection 53 slides against the rear end face 63*b* of the engaging projection 63 with a strong force upon the engagement of the connectors, when the engaging and coming off operations are implemented repeatedly, each projection 53 or 63 is worn down and deformed, causing the possibility that the locking force deteriorates and that a large inertial force cannot be obtained, that is, the inertial locking is not implemented.

SUMMARY OF THE INVENTION

It is therefore an objective of the present invention to solve the above problem and to provide an inertial locking connector, by which the incomplete engagement of the connectors due to that the locking projection climbs on the engaging projection to stop there is prevented from occurring, and the appropriation and compatibility of the connector are improved, and the deterioration in the inertial force and the locking force due to the deformation and wear of the locking and engaging projections are prevented from occurring.

In order to attain the above objective, a first aspect of the present invention is to provide an inertial locking connector comprising: a first connector housing provided with a locking arm having a locking projection; and a second connector housing provided with an engaging projection, which engages with the locking projection, wherein upon engaging of the first and second connecor housings, a front end face of the locking projection is situated facing a perpendicular front end face of the second connector housing and the front end face of the locking projection abuts against the front end face of the second connector housing.

The front end face of the locking projection is formed inclined by an appropriate angle equal to or less than 90° in response to the magnitude of the inertia force.

There is provided a distance between the front end face of the second connector housing and the engaging projection thereof for the locking projection to slide.

Upon engaging of the first and second connecor housings, the locking projection climbs over the engaging projection to complete the engagement between the locking projection and the engaging projection, with the locking arm being bent.

According to the first aspect of the present invention, since the locking projection of the locking arm of the first connector housing abuts against the front end face of the second connector housing, when an operator presses both connector housings in the engaging direction thereof with a strong force, the locking arm is bent and at the same time the inertia force is exhibitted in the engaging direction of the connectors, the locking projection of the locking arm advances powerfully toward the engaging projection situated more rear compared to the front end face of the second connector housing. Therefore, there is no possibility that both connectors stop staying in half engaged condition (i.e. incomplete engaged condition) in a state that the locking projection of the locking arm of the first connector climbs on the engaging projection of the second connector, thereby the connectors are securely engaged and locked with each other.

Further, since the engaging projection of the second connector housing needs no construction (for example, to make the angle of the front end face of the engaging projection have a steep slope) for the inertial locking, a normal connector that is not for the inertial locking can be employed as the second connector, thereby decreasing the cost of parts. In addition, as a normal connector, a plurality of kinds of connector can be compatible with each other from the viewpoints of presence or absence of the waterproof rubber stopper and different total length of the connectors, thereby the degree of freedom for disposing position of the connectors and for connection form thereof is increased.

Furthermore, upon the connector engagement, the locking projection of the locking arm strongly abuts against and slides on the front end face of the connector housing, therefore the locking projection does not strongly press the engaging projection, thereby the deformation and wear of the engaging projection are prevented from occurring and the locking force does not deteriorate even when the connectors are repeatedly engaged with and separated from each other. Since the locking arm bends by a pressing force having a specified magnitude, the deformation and wear of the locking projection do not take place. Since the front end face of the connector housing has a high stiffness in the abutting direction, the front end face neither be bent, deformed, nor worn by abutting against the locking projection of the locking arm, therefore a large inertia force is exhibitted.

A second aspect of the present invention is to provide an inertial locking connector comprising: a first connector housing provided with a locking arm having a locking hole; and a second connector housing provided with an engaging projection, which engages with the locking hole, wherein upon engaging of the first and second connecor housings, a perpendicular front end face of the locking arm is situated facing a front end face of the engaging projection and the front end face of the locking arm abuts against the front end face of the engaging projection.

The front end face of the engaging projection is formed inclined by an appropriate angle equal to or less than 90° in response to the magnitude of the inertia force.

According to the second aspect of the present invention, since the locking arm is provided with not the locking projection but the locking hole, upon the engagement of the connectors, the front end of the locking arm abuts against the engaging projection, and when the locking arm bends so that both connectors engage with each other by the inertia force, the locking hole slides well with regard to the engaging projection compared to the case of the locking projection, thereby there is no possibility that the front end of the locking arm climbs on the engaging projection to stay there, that is, the incomplete engagement of the connectors never takes place. Further, since there is no locking projection, there is no problem of the wear and deformation of the locking projection. The locking is implemented in a state that upon the engagement of the connectors the locking hole engages with the engaging projection and the locking arm is recovered to the reverse direction of the bending, therefore the resilient force of the locking arm is prevented from deterirating with time passing by.

A third aspect of the present invention is to provide an inertial locking connector comprising: a first connector housing provided with a locking arm having a locking hole; and a second connector housing provided with an engaging projection, which engages with the locking hole, wherein the first connector housing is provided with an arm for inertial locking and the arm for inertial locking is provided with an abutting projection for abutting against a front end face of the second connector housing.

A pair of the arm for inertial locking is adjacently formed at both sides of the locking arm.

The arm for inertial locking and the locking arm are integrally formed with putting a slit therebetween.

According to the third aspect of the present invention, a large friction force does not applied to the engaging projection of the second connector housing upon the engagement of the connectors, thereby the wear of the engaging projection is prevented from occurring and the locking of the connectors is always securely implemented with high accuracy.

Further, since the projection of the arm for inertial locking abuts against the front end face of the second connector housing, when an operator presses both connector housings in the engaging direction thereof with a strong force and the arm for inertial locking is bent so as to engage both connector housings with each other by the inertia force, the locking arm advances powerfully toward the engaging projection situated more rear compared to the front end face of the second connector housing and the engaging projection engages with the locking hole at a stretch, therefore the incomplete engagement of the connectors never takes place, i.e. the connectors are securely engaged and locked with each other.

Furthermore, since the engaging projection of the second connector housing needs no construction for the inertial locking, a normal connector that is not for the inertial locking can be employed as the second connector, thereby decreasing the cost of parts. In addition, as a normal connector, a plurality of kinds of connector can be compatible with each other from the viewpoints of presence or absence of the waterproof rubber stopper and different total length of the connectors, thereby the degree of freedom for disposing position of the connectors and for connection form thereof is increased.

BRIEF DESCRIPTION OF THE DRAWINGS

FIG. 3 is a perspective view illustrating a female connector of the inertial locking connector according to the first preferred embodiment of the present invention;

FIGS. 4A, 4B and 4C are primary longitudinal sectional views illustrating states that the locking projection of the locking arm of a connector faces the front end face of an opposite connector housing, then abuts against the front end face and then, engages with the engaging projection;

FIG. 8 is a longitudinal sectional view illustrating the male connector of the inertial locking connector according to the third preferred embodiment of the present invention; and FIG. 9 is a longitudinal sectional view illustrating an example of a conventional inertial locking connector.

DESCRIPTION OF THE PREFERRED EMBODIMENTS

Figure 1:
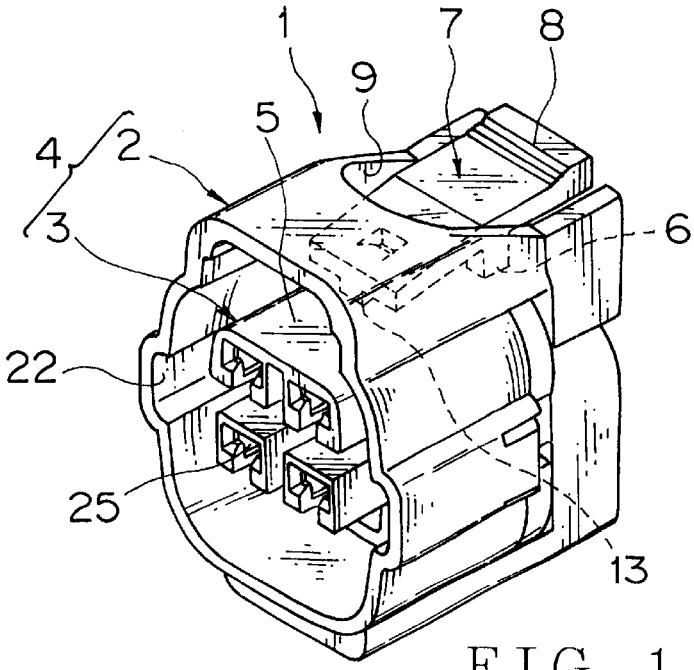
FIG. 1 is a perspective view illustrating a male connector of an inertial locking connector according to a first preferred embodiment of the present invention.
Figure 2:
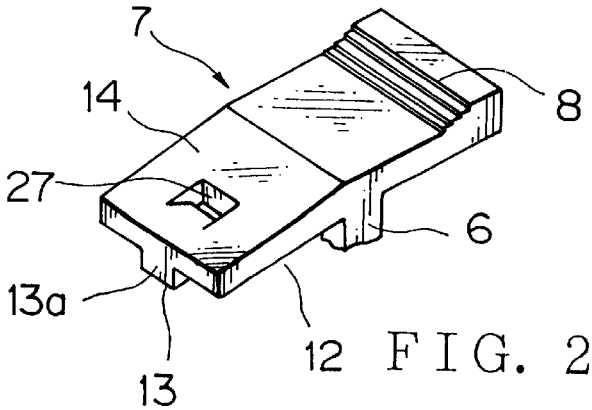
FIG. 2 is a perspective view illustrating a locking arm of the male connector.

In the following, the preferred embodiments of the present invention will be explained with reference to the attached drawings. FIGS. 1 to 3 illustrate an inertial locking connector according to a first preferred embodiment of the present invention, in which FIG. 1 shows a male connector, FIG. 2 shows a flexible locking arm of the male connector, and FIG. 3 shows a female connector. The inertial locking connector comprises the male and female connectors.

As shown in FIG. 1, the male connector 1 has a connector housing 4 consisting of a hood part 2 made of synthetic resin and an inner housing (terminal receiving part) 3, and a locking arm 7 is integrally formed with an upper wall (wall part) 5 putting a holding part 6 therebetween. The front half of the locking arm 7 is situated inside the hood part 2, while the rear half thereof including a pushing operation part 8 is exposed from an opening 9 of the hood part 2. As shown in FIG. 2, the holding part 6 of the locking arm 7 is perpendicularly formed at both sides of the central portion in the length direction of the locking arm 7, and an insertion space 12 for an engaging projection 11 of the female connector 10 shown in FIG. 3 is provided between a pair of the holding part 6. The locking arm 7 is rotatable in the thickness direction of the plate of the locking arm 7 (i.e. locking and releasing directions) with using the holding part 6 as a fulcrum.

As shown in FIG. 2, a locking projection 13 for abutting and for locking is downwardly formed at the front end center of the locking arm 7. As shown in FIG. 4A, a front end face (abutting face) 13*a* of the locking projection 13 continues downwardly from a perpendicular front end face 14*a* of the plate-shaped body 14 of the locking arm 7 and is inclined backward a little having a taper shape. The inclined angle $\theta_1$ of the front end face 13*a* of the locking projection 13 from the perpendicularity is appropriately set up in response to a force needed for the engagement of both connectors 1 and 10.

The inclined angle $\theta_1$ of the front end face 13*a* is gradually changed so as to finely adjust the inertia force. That is, when a large inertia force is needed, the angle $\theta_1$ is set to be near zero, on the other hand, when a small inertia force is needed, the angle $\theta_1$ is set large. The inclined angle $\theta_2$ of the locking projection 13 from the horizontality is equal to or less than 90°. In any case, the inertia force is set larger than the sum of a force needed for insertion of the male and female terminals, which has been mentioned in the conventional example, and a force needed for engaging the waterproof packing with the connector housing.

As shown in FIG. 4A, a rear end face 13*b* of the locking projection 13 is inclined backward by an angle equal to or more than that of the front end face 13*a* and as shown in FIG. 4C, functions as a locking face, which engages with the engaging projection 11 of the mating female connector 10. A primary distinctive feature of the inertial locking connector according to the present preferred embodiment is that as shown in FIG. 4A the front end face 13*a* of the locking projection 13 is situated facing not the engaging projection 11 of the mating female connector 10 but a front end face 17*a* of a wall part (upper wall) 17, which constitutes a connector engaging chamber 16 of a connector housing 15 (see FIG. 3), and abuts against the front end face 17*a* of the wall part 17 as shown in FIG. 4B.

In FIG. 3, the female connector 10 is a known connector, to which no processing is added to make the connector an inertial locking connector. On the upper wall 17 of the female connector housing 15, the engaging projection 11 is disposed a little backward compared to the front end face 17*a* of the upper wall 17, and has an acute inclined guiding face 11*a* at the front and an approximately perpendicular abutting face 11*b* at the rear. An angle of the inclined guiding face 11*a* is smaller than the inclined angle $\theta_2$ (see FIG. 4A) of the locking projection 13 of the locking arm 7 (see FIG. 1).

The front end face 17*a* of the upper wall 17 of the female connector housing 15 functions as an abutting part, which abuts against the locking projection 13. The front end face 17*a* of the upper wall 17 is constituted by a perpendicular face similarly to each front end face of both sidewalls 18 and lower wall 19 of the connector housing 15, and each front end face continues to an inner guiding tapered surface 20. The inner housing 3 of the male connector 1 (see FIG. 1) is inserted along the guiding tapered surface 20.

At both sides of the engaging projection 11, the upper wall 17 is provided with a pair of guiding plate 21, which advances to the outside of the locking arm 7 (see FIG. 1). Each sidewall 18 is provided with a guiding projection 23, which advances into a side groove 22 of the hood part 2 (see FIG. 1). Male terminals (not shown in the figure) having a wire is received into the rear half of the connector housing 15 and a waterproof rubber stopper (not shown in the figure) is fit in a wire guiding part 24 at the rear.

In FIG. 1, female terminals (not shown in the figure) having a wire is received into the inner housing 3 of the male connector 1. There are four terminal receiving chambers 25 in the present preferred embodiment. A waterproof packing (not shown in the figure) is fit to a base part of the inner housing 3.

After each terminal is inserted into the male and female connector housing 4 and 15, both connectors 1 and 10 are engaged with each other. Upon an initial stage of this engagement, as shown in FIG. 4B, the locking projection 13 of the locking arm 7 abuts against not the engaging projection but the front end face 17*a* of the mating connector housing 15. Then, the operator pushes both connectors 1 and 10 in the engaging direction with a strong force, resulting in that the front end face 13*a* of the locking projection 13 slides on an upper end of the front end face 17*a* of the connector housing 15 while the locking arm 7 bends upward, then the locking projection 13 climbs over the engaging projection 11 at a stretch and engages with the rear side of the engaging projection 11.

The locking arm 7 keeps the locked state as the locking arm 7 is bent upward. As the locking arm 7 is bent upward, the rear end face (locking face) 13*b* of the locking projection 13 stands about perpendicularly and abuts against the perpendicular rear end face (engaging face) 11*b* at the rear of the locking projection 11, thereby a strong locking force is attained. At the initial state shown in FIG. 4A, an inclined angle of the rear end face 13*b* of the locking projection 13 is set equal to or smaller than 90° similarly to the front end face 13*a*. In the connector engaged state shown in FIG. 4C, the locking arm 7 resiliently energizes the upper wall 17 of the connector housing 15 and the locking projection 11 downward, therefore the locking arm 7 is prevented from coming off abruptly, the locking arm is firmly engaged with the engaging projection, and a frictional wear due to the vibration and the like during the running of the vehicle never takes place.

Differently from the prior art, according to the present preferred embodiment, the inertia force is obtained not by abutting the projections 11 and 13 against each other but at the preceding stage when the locking projection 13 abuts against the front end face 17*a* of the connector housing 15, thereby the inertia force makes the locking projection 13 climb over the engaging projection 11 at a stretch. Consequently, there is no possibility that both connectors 1 and 10 stop staying in half engaged condition (i.e. incomplete engaged condition) in a state that the locking projection 13 climbs on the engaging projection 11.

As shown in FIG. 4A, the effect described above is further promoted by a construction that a small distance L between the front end face 17*a* of the connector housing 15 and the engaging projection 11 for the locking projection 13 to slide is provided. That is, as shown in FIG. 4B, after the locking projection 13 abuts against the front end face 17*a* of the connector housing 15, the locking projection 13 is accelerated until it climbs over the engaging projection 11, thereby the locking projection 13 can more securely climb over the engaging projection 11.

As shown in FIG. 4B, the front end face 13*a* of the locking projection 13 strongly abuts against and slides on the front end face 17*a* of the connector housing 15, therefore the locking projection 13 does not strongly press the engaging projection, thereby the deformation and wear of the engaging projection 11 are prevented from occurring and the locking force does not deteriorate even when the connectors 1 and 10 are repeatedly engaged with and separated from each other.

As shown in FIG. 3, the front end face 17*a* of the connector housing 15 extends far longer than the width of the locking projection 13 (see FIG. 2), therefore the front end face 17*a* has a high stiffness, thereby the front end face 17*a* is hardly deformed and the wear thereof is very little even when the connectors 1 and 10 are repeatedly engaged with and separated from each other. The locking projection 13 bends together with the locking arm 7, thereby the wear and deformation thereof hardly take place. Consequently, the inertia force does not deteriorate even when the connectors 1 and 10 are repeatedly engaged with and separated from each other.

As shown in FIGS. 2 and 4, at an upper side of the locking projection 13, there may be provided a notched hole 27 in a main portion 14 of the locking arm 7 so that the locking projection 13 can slightly bend as it can rotate according to a direction, to which it is pressed. The amount of the bend is set so as not to damage the inertia force. Thereby, the deformation and wear of the locking projection 13 are also securely prevented from occurring.

As shown by a chain line in FIG. 4A, the front end face 13*a* of the locking projection 13 may be formed perpendicular to the connector engaging direction and in this case, the front end face 13*a* of the locking projection 13 abuts against the whole surface of the front end face 17*a* in a range of about the plate thickness T of the upper wall 17 of the connector housing 15, thereby a very large inertia force can be produced when the locking arm 7 bends. The magnitude of the inertia force is set suitably according to the type of the connector, and the locking projection having such a perpendicular front end face can be employed when the number of the terminals is very large and the connector having a waterproof packing is large.

In FIG. 4C, in order to delete the bend of the locking arm 7, the locking arm 7 may be provided with a hole (by enlarging the size of the notched hole 27) for allowing the engaging projection 11 to advance and the connector housing 15 may be provided with a hole (not shown in the figure) for allowing the locking projection 13 to advance, thereby the resilient force of the locking arm 7 is prevented from deterirating with time passing by.

Figure 5:
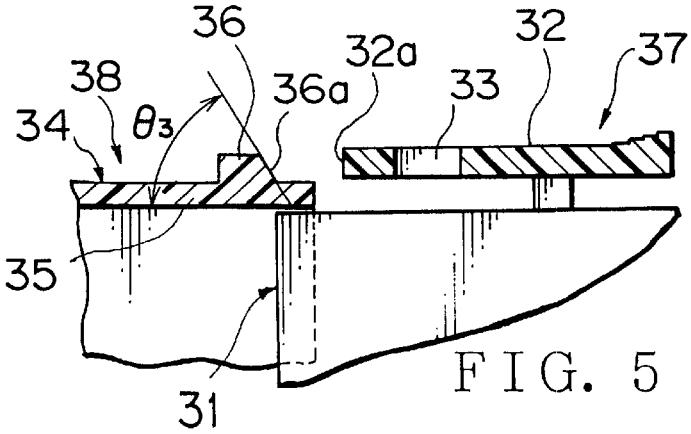
FIG. 5 is a primary longitudinal sectional view illustrating an inertial locking connector according to a second preferred embodiment of the present invention.

FIG. 5 is a primary longitudinal sectional view illustrating an inertial locking connector according to a second preferred embodiment of the present invention. As shown in FIG. 5, instead of providing a locking projection on a plate-shaped locking arm 32 of one connector housing 31, a locking hole 33 is provided at the front end side, while an engaging projection 36 engaging with the locking hole 33 is provided on an upper wall 35 of an opposite connector housing 34 so that a front end face 32*a* of the locking arm 32 abuts against an inclined front end face 36*a* of the engaging projection 36 so as to produce the inertia force, then the locking hole 33 engages with the engaging projection 36 at the same time when both connectors 37 and 38 engage with each other.

In this second preferred embodiment, if the locking arm 32 has a perpendicular (to the connector engaging direction) front end face 32*a*, a known connector can be employed as the one connector 37. As for the opposite connector 38, the inclined angle of the engaging projection 36 has to be set an angle near to 90° as the inertial locking connector as shown in FIG. 5. An inclined angle $\theta_3$ of a front end face 36*a* of the engaging projection 36 is set an angle equal to or smaller than 90° according to the inertia force. The angle $\theta_3$ is an inclined angle of the front end face 36*a* with regard to a wall surface (horizontal plane) of the connector housing 34.

In the preferred embodiment shown in FIG. 5, not a locking projection but the main portion of the locking arm 32 climbs on the engaging projection, therefore the sliding property thereof with regard to the engaging projection is good, the locking hole 33 can easily engages with the engaging projection 36 with the momentum of the climbing on thereof, thereby an incomplete engagement of the connectors hardly takes place.

In the preferred embodiment shown in FIG. 1, a connector without the hood part 2 may be employed as the male connector 1. In this case, the inner housing 3 is used as a rectangular block-shaped connector housing and a waterproof packing outside of the housing is not used.

Instead of the female connector 38 shown in FIG. 5, a wall portion (35) constituting a connector engaging chamber of the female connector housing (35) may be notched by a pair of slits (not shown in the figure) so as to form a locking arm (32) between both slits, the locking arm may be provided with a locking hole (33) similarly to FIG. 5, an outer wall of the male connector housing may be provided with an engaging projection (36) engaging with the locking hole (33), thereby a front end face of the locking arm (32) abuts against a front end face of the engaging projection (36) to obtain the inertia force.

Further, the front end face 13*a* of the locking projection 13 of the locking arm 7 of the male connector 1 in FIG. 1 may directly slide on the front end face 11*a* of the engaging projection 11 of the female connector 10, thereby the connector can be used not as an inertial locking connector but as a normal connector. Furthermore, the shape of the locking arm 7 is not limited to the shape that the central part of the locking arm 7 in the length direction is held by the holding part 6 (see FIG. 2), and the shape may be a shape that the rear end of the locking arm 7 is held as a cantilever.

Figure 6:
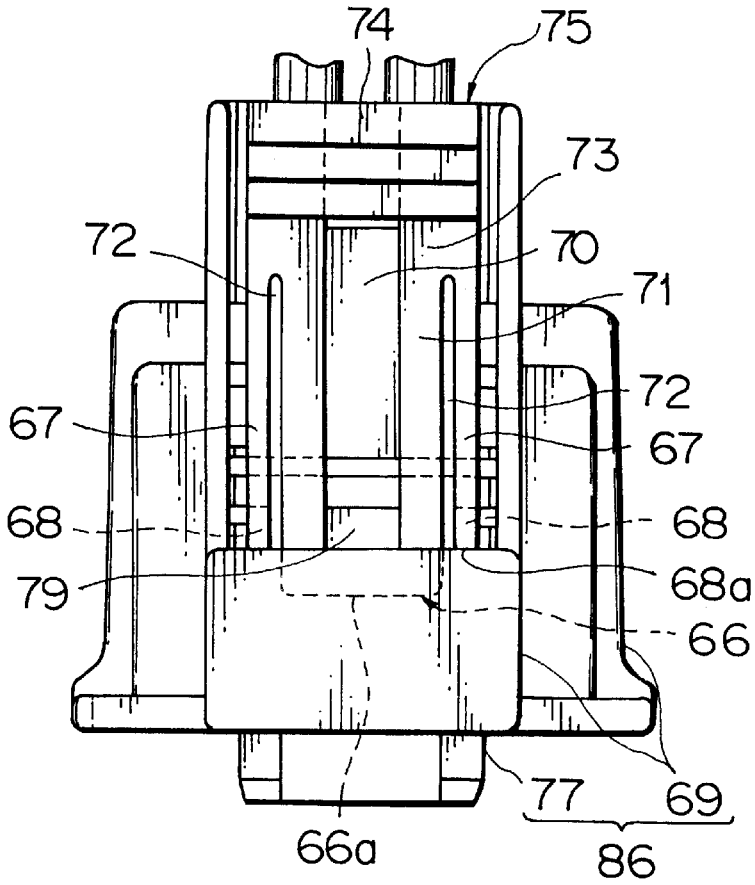
FIG. 6 is a plan view illustrating a male connector of an inertial locking connector according to a third preferred embodiment of the present invention.
Figure 7:
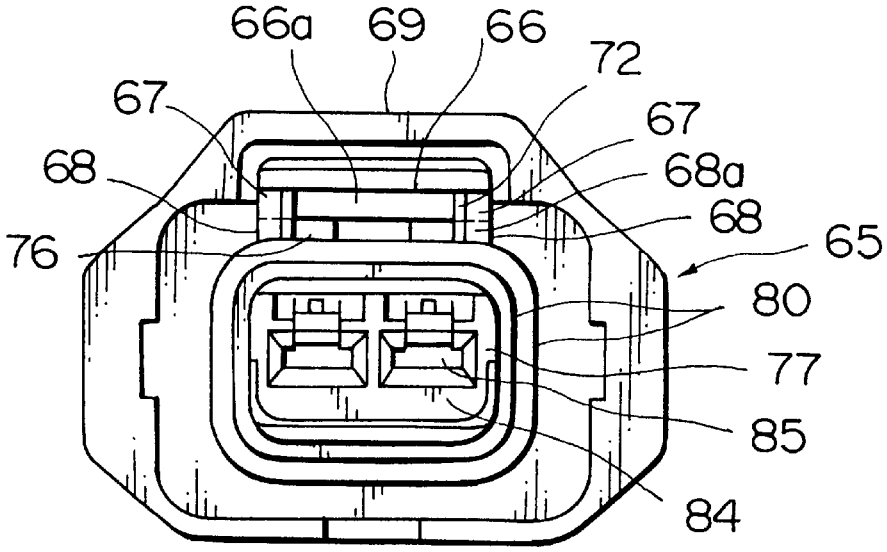
FIG. 7 is a front view illustrating the male connector of the inertial locking connector according to the third preferred embodiment of the present invention.

FIGS. 6–8 illustrate a male connector 65 of an inertial locking connector according to a third preferred embodiment of the present invention.

Besides the locking arm 66 for locking the connectors, the inertial locking connector 65 according to the third preferred embodiment is also provided with an arm 67 for inertial locking, with a front end which has an abutting projection 68 which is integrally formed so that a front end face 68*a* of the abutting projection 68 abuts against a front end face 17*a* of a connector housing of the mating female connector 15, thereby the inertia force can be obtained. Both male and female connectors constitute the inertial locking connector.

As shown in FIGS. 6 and 7, the locking arm 66 is disposed inside the hood part 69 made of synthetic resin and a pair of the arms 67 for inertial locking is provided adjacently to both sides of the locking arm 66. Each arm 67 is formed narrow (about half of the width of a plate part 71 at both sides of a hollow part 70 of the locking arm 66) compared to the locking arm 66, the front end 68*a* of the arm 67 is situated a little backward compared to a front end 66*a* of the locking arm 66, each arm 67 and the locking arm 66 are situated closely with each other with putting a slit 72 therebetween, a base part of each arm 67 and that of the locking arm 66 are integrated with each other as a common arm base 73, and a pushing operation part 74 is provided at the rear end side of the arm base 73.

The locking arm 66 and a pair of the arm 67 for inertial locking constitute an arm structural unit 75, thereby the structure is simplified and compacted compared to a case, in which the locking arm and the arm for inertial locking are separately formed, and molding workability with using resin is improved.

As shown in FIG. 8, the locking arm 66 and the arm 67 are situated on the same horizontal plane, a holding part 76 is formed a little forward at both sides of the arm base 73, and the holding part 67 connects the arm base 73 to an upper wall 78 of an inner housing 77. By pressing the pushing operation part 74 downward, both arms 66 and 67, i.e. the arm structural unit 75 rotates upward with the holding part 76 as a fulcrum. (This is an operation when the connectors are to be separated from each other.)

The locking arm 66 has a connecting wall 79 at the front end side thereof and the rectangle plate part 71 (see FIG. 6) at both sides, right and left, and the hollow part 70 surrounded by the connecting wall 79 and both plate parts 71 functions as a locking hole 70 for engaging with the engaging projection (11 in FIG. 3) of the mating female connector. At both sides of the connecting wall 79, the abutting projection 68 of a pair of the arm 71, right and left, is situated protrudingly more downward compared to the connecting wall 79. The rear end face 68*b* (see FIG. 8) of the abutting projection 68 is inclined a little and situated at the lower side of about the side of a rear end 79*a* of the connecting wall 79. The front end face 68*a* of the abutting projection 68, i.e. an abutting face for abutting against the front end face (17*a*) of the mating female connector housing (15 in FIG. 3) is perpendicularly formed with an angle 90° in the third preferred embodiment.

A waterproof packing 80 is situated under the abutting projection 68, which is fit to the base side of the inner housing 77. The waterproof packing 80 enlarges a force needed for engaging with the mating female connector (10 in FIG. 3), also causing a necessity of the inertial locking. Female terminals 81 (see FIG. 8) are inserted into the inner housing 77, each female terminal 81 has a solderless contact with a wire 82, on which a waterproof rubber stopper 83 is fit. The female terminals 81 are arranged in parallel and as shown in FIG. 7 a front wall 84 of the inner housing 77 is provided with an insertion hole 85 for inserting the male terminal of the mating connector. The hood part 69 and the inner housing 77 integrally constitute a connector housing 86 (see FIG. 8) made of synthetic resin.

When the male and female connectors 65 and (10) are engaged with each other, the front end face (17*a*) of the connecter housing (15) of the mating female connector (10) abuts against the projection 68 of a pair of the arms 67 for inertial locking. At almost the same time, the engaging projection (11) of the female connector (10) slips into the bottom of the front end 66*a* of the locking arm 66 and may bend the locking arm 66 upward a little. Even in such a case, since the locking arm 66 and the arms 67 for inertial locking at right and left are separated by the slit 72, the bend of the locking arm 66 is not transmitted to the arms 67, thereby the arms 67 for inertial locking does not bend and keeps situating horizontally and can firmly hold the front end face (17*a*) of the mating connector housing (15).

When an abutting force between the projection 68 of the arm 67 for inertial locking and the front end face (17*a*) of the female connector housing (15) exceeds a sum of the insertion force worked between the male and female terminals and the insertion force for the waterproof packing 80 to be inserted into the female connector housing (15), a pair of the arms 67 bends upward, thereby the male and female connectors, 65 and (10), respectively, engage at a stretch with each other. At the same time, the engaging projection (11) engages with the locking hole 70 of the locking arm 66, thereby both connectors 65 and (10) are locked (inertially locked) without coming off.

In the third preferred embodiment described above, the front end face 68*a* of the projection 68 of the arm 67 for inertial locking may be formed inclined by a suitable angle equal to or smaller than 90° according to the magnitude of the inertia force, similarly to the locking projection 13 of the locking arm 7 (see FIG. 1) of the first preferred embodiment.

The aforementioned preferred embodiments are described to aid in understanding the present invention and variations may be made by one skilled in the art without departing from the spirit and scope of the present invention.

What is claimed is:

1. An inertial locking connector comprising:

a first connector housing provided with a locking arm having a locking projection; and a second connector housing provided with an engaging projection, which engages with the locking projection, wherein upon engaging of the first and second connector housings, a front end face of the locking projection is situated facing a perpendicular front end face of the second connector housing and the front end face of the locking projection abuts against the front end face of the second connector housing.

2. The inertial locking connector according to claim 1, wherein the front end face of the locking projection is formed inclined by an appropriate angle equal to or less than 90° in response to the magnitude of the inertia force.

3. The inertial locking connector according to claim 2, wherein there is provided a distance between the front end face of the second connector housing and the engaging projection thereof for the locking projection to slide.

4. The inertial locking connector according to claim 1, wherein there is provided a distance between the front end face of the second connector housing and the engaging projection thereof for the locking projection to slide.

5. The inertial locking connector as claimed in any one of claims 1 to 4, wherein upon engaging of the first and second connector housings, the locking projection climbs over the engaging projection to complete the engagement between the locking projection and the engaging projection, with the locking arm being bent.

6. An inertial locking connector comprising:

a first connector housing provided with a locking arm having a locking hole; and a second connector housing provided with an engaging projection, which engages with the locking hole, wherein the first connector housing is provided with an arm for inertial locking and the arm for inertial locking is provided with an abutting projection for abutting against a front end face of the second connector housing, and said locking arm and said arm for inertial locking extend from a common arm base.

7. The inertial locking connector according to claim 6, wherein a pair of the arm for inertial locking is adjacently formed at both sides of the locking arm.

8. An inertial locking connector comprising:

a first connector housing provided with a locking arm having a locking hole; and a second connector housing provided with an engaging projection, which engages with the locking hole, wherein the first connector housing is provided with an arm for inertial locking and the arm for inertial locking is provided with an abutting projection for abutting against a front end face of the second connector housing, and the arm for inertial locking and the locking arm are integrally formed with a slit therebetween.

9. An inertial locking connector comprising:

a first connector housing provided with a locking arm having a locking hole; and a second connector housing provided with an engaging projection, which engages with the locking hole, wherein the first connector housing is provided with a pair of arms for inertial locking and the pair of arms for inertial locking are provided with an abutting projection for abutting against a front end face of the second connector housing, one of the pair of arms for inertial locking being adjacently formed at each side of the locking arm, and each arm for inertial locking and the locking arm are integrally formed with a slit therebetween.

* * * * *